US011554374B2

(12) United States Patent
Zhitomirsky et al.

(10) Patent No.: US 11,554,374 B2
(45) Date of Patent: Jan. 17, 2023

(54) SPATIALLY VARIABLE DIELECTRIC LAYERS FOR DIGITAL MICROFLUIDICS

(71) Applicant: Nuclera Nucleics Ltd., Cambridge (GB)

(72) Inventors: David Zhitomirsky, Woburn, MA (US); Cristina Visani, Cambridge, MA (US)

(73) Assignee: Nuclera Nucleics Ltd., Cambridge (GB)

( * ) Notice: Subject to any disclaimer, the term of this patent is extended or adjusted under 35 U.S.C. 154(b) by 192 days.

(21) Appl. No.: 17/150,578

(22) Filed: Jan. 15, 2021

(65) Prior Publication Data

US 2021/0220830 A1 Jul. 22, 2021

Related U.S. Application Data

(60) Provisional application No. 62/962,238, filed on Jan. 17, 2020.

(51) Int. Cl.
*B01L 3/00* (2006.01)

(52) U.S. Cl.
CPC ..... *B01L 3/502784* (2013.01); *B01L 2200/14* (2013.01); *B01L 2300/06* (2013.01); *B01L 2300/16* (2013.01); *B01L 2400/0427* (2013.01)

(58) Field of Classification Search
CPC ..... B01L 3/502784; B01L 2200/14; B01L 2300/06; B01L 2300/16; B01L 2400/0427; B01L 2200/12; B01L 3/502792
See application file for complete search history.

(56) References Cited

U.S. PATENT DOCUMENTS

| | | | |
|---|---|---|---|
| 3,813,519 | A | 5/1974 | Jochin et al. |
| 5,311,337 | A | 5/1994 | McCartney, Jr. |
| 5,964,995 | A | 10/1999 | Nikiforov et al. |
| 6,352,758 | B1 | 3/2002 | Huang et al. |

(Continued)

FOREIGN PATENT DOCUMENTS

| | | | |
|---|---|---|---|
| JP | 2013076739 | A | 4/2013 |
| TW | 200916823 | A | 4/2009 |

(Continued)

OTHER PUBLICATIONS

Abdelgawad, Mohamed et al., "The Digital Revolution: A New Paradigm for Microfluidics", Advanced Materials, vol. 21, pp. 920-5,(2009). Jan. 1, 2009.

(Continued)

*Primary Examiner* — Jennifer Wecker
*Assistant Examiner* — Oyeleye Alexander Alabi
(74) *Attorney, Agent, or Firm* — McCarter & English, LLP

(57) ABSTRACT

A digital microfluidic device including an active matrix of propulsion electrodes controlled by thin-film-transistors. The device includes at least two areas of different propulsion electrode densities. One area may be driven by directly-driving the propulsion electrodes from a power supply or function generator. In the first, higher density region; a first dielectric layer covers the propulsion electrodes. The first dielectric layer has a first dielectric constant and a first thickness. In the second, lower density region, a second dielectric layer has a second dielectric constant and a second thickness covering the propulsion electrodes.

17 Claims, 4 Drawing Sheets

(56) References Cited

U.S. PATENT DOCUMENTS

| | | | |
|---|---|---|---|
| 6,565,727 | B1 | 5/2003 | Shenderov |
| 6,773,566 | B2 | 8/2004 | Shenderov |
| 6,911,132 | B2 | 6/2005 | Pamula et al. |
| 6,967,489 | B2 | 11/2005 | Brooks et al. |
| 6,977,033 | B2 | 12/2005 | Becker et al. |
| 7,052,244 | B2 | 5/2006 | Fouillet et al. |
| 7,053,009 | B2 | 5/2006 | Conley, Jr. et al. |
| 7,163,612 | B2 | 1/2007 | Sterling et al. |
| 7,215,306 | B2 | 5/2007 | Lo |
| 7,328,979 | B2 | 2/2008 | Decre et al. |
| 7,420,549 | B2 | 9/2008 | Jacobson et al. |
| 7,458,661 | B2 | 12/2008 | Kim et al. |
| 7,504,709 | B2 | 3/2009 | Masuda et al. |
| 7,531,072 | B2 | 5/2009 | Roux et al. |
| 7,547,380 | B2 | 6/2009 | Velev |
| 7,641,779 | B2 | 1/2010 | Becker et al. |
| 7,733,559 | B2 | 6/2010 | Kawase et al. |
| 7,767,069 | B2 | 8/2010 | Lee et al. |
| 7,902,680 | B2 | 3/2011 | Tano et al. |
| 7,976,795 | B2 | 6/2011 | Zhou et al. |
| 8,053,239 | B2 | 11/2011 | Wheeler et al. |
| 8,093,064 | B2 | 1/2012 | Shah et al. |
| 8,128,798 | B2 | 3/2012 | Adachi et al. |
| 8,159,644 | B2 | 4/2012 | Takatori |
| 8,173,000 | B1 | 5/2012 | Hadwen et al. |
| 8,187,864 | B2 | 5/2012 | Wheeler et al. |
| 8,319,759 | B2 | 11/2012 | Jacobson et al. |
| 8,349,276 | B2 | 1/2013 | Pamula et al. |
| 8,388,909 | B2 | 3/2013 | Pollack et al. |
| 8,409,417 | B2 | 4/2013 | Wu |
| 8,460,528 | B2 | 6/2013 | Pollack et al. |
| 8,514,479 | B2 | 8/2013 | Bae et al. |
| 8,525,966 | B2 | 9/2013 | Takatori |
| 8,529,743 | B2 | 9/2013 | Kim et al. |
| 8,547,111 | B2 | 10/2013 | Hadwen et al. |
| 8,587,513 | B2 | 11/2013 | Ozawa |
| 8,593,438 | B2 | 11/2013 | Komatsu et al. |
| 8,603,413 | B2 | 12/2013 | Fouillet |
| 8,653,832 | B2 | 2/2014 | Hadwen et al. |
| 8,764,958 | B2 | 7/2014 | Wang |
| 8,791,891 | B2 | 7/2014 | Van Dijk et al. |
| 8,810,882 | B2 | 8/2014 | Heikenfeld et al. |
| 8,815,070 | B2 | 8/2014 | Wang et al. |
| 8,834,695 | B2 | 9/2014 | Wang et al. |
| 8,858,772 | B2 | 10/2014 | Crane et al. |
| 8,926,811 | B2 | 1/2015 | Wu |
| 8,936,708 | B2 | 1/2015 | Feiglin et al. |
| 8,940,147 | B1 | 1/2015 | Bartsch et al. |
| 8,958,044 | B2 | 2/2015 | Takatori |
| 8,993,348 | B2 | 3/2015 | Wheeler et al. |
| 8,994,705 | B2 | 3/2015 | Jacobson et al. |
| 9,061,262 | B2 | 6/2015 | Vann et al. |
| 9,216,414 | B2 | 12/2015 | Chu |
| 9,266,076 | B2 | 2/2016 | Kim et al. |
| 9,458,489 | B2 | 10/2016 | Lim et al. |
| 9,458,543 | B2 | 10/2016 | Hadwen |
| 9,476,811 | B2 | 10/2016 | Mudrik et al. |
| 9,594,056 | B2 | 3/2017 | Fobel et al. |
| 9,610,582 | B2 | 4/2017 | Kapur et al. |
| 9,623,407 | B2 | 4/2017 | Delamarche et al. |
| 9,634,145 | B2 | 4/2017 | Ellinger et al. |
| 9,649,632 | B2 | 5/2017 | Van Dam et al. |
| 9,714,463 | B2 | 7/2017 | White et al. |
| 9,815,056 | B2 | 11/2017 | Wu et al. |
| 9,915,631 | B2 | 3/2018 | Hoffmeyer et al. |
| 9,952,423 | B2 | 4/2018 | De Greef et al. |
| 9,983,169 | B2 | 5/2018 | Bramanti |
| 10,018,828 | B2 | 7/2018 | Massard |
| 10,133,057 | B1 | 11/2018 | Petcu et al. |
| 10,486,156 | B2 | 11/2019 | Campbell et al. |
| 10,543,466 | B2 | 1/2020 | Wu |
| 10,646,454 | B2 | 5/2020 | Liu et al. |
| 10,882,042 | B2 | 1/2021 | French |
| 2006/0039823 | A1 | 2/2006 | Yamakawa et al. |
| 2007/0023292 | A1 | 2/2007 | Kim et al. |
| 2008/0124252 | A1 | 5/2008 | Marchand et al. |
| 2010/0032293 | A1 | 2/2010 | Pollack et al. |
| 2010/0225611 | A1 | 9/2010 | Lee et al. |
| 2012/0273702 | A1 | 11/2012 | Culbertson et al. |
| 2013/0161193 | A1 | 6/2013 | Jacobs et al. |
| 2015/0377831 | A1 | 12/2015 | Wheeler et al. |
| 2016/0199832 | A1 | 7/2016 | Jamshidi et al. |
| 2016/0312165 | A1 | 10/2016 | Lowe, Jr. et al. |
| 2017/0315090 | A1 | 11/2017 | Wheeler et al. |
| 2018/0246058 | A1* | 8/2018 | Bramanti ..... B01L 3/50273 |
| 2019/0210026 | A1 | 7/2019 | Jebrail et al. |
| 2020/0064705 | A1 | 2/2020 | Kayal et al. |
| 2020/0089035 | A1 | 3/2020 | Tsai et al. |
| 2020/0114135 | A1 | 4/2020 | Paolini, Jr. et al. |
| 2020/0347840 | A1 | 11/2020 | Paolini, Jr. et al. |
| 2020/0348576 | A1 | 11/2020 | Visani et al. |

FOREIGN PATENT DOCUMENTS

| | | | |
|---|---|---|---|
| WO | 2007120241 | A2 | 10/2007 |
| WO | 2017075295 | A1 | 5/2017 |

OTHER PUBLICATIONS

Choi, Kihwan et al., "Digital Microfluidics", Annu. Rev. Anal. Chem. 5:413-40 (2012). Apr. 9, 2012.

Qi, Lin et al., "Mechanical-activated digital microfluidics with gradient surface wettability", Lab Chip, vol. 19, pp. 223-232, (2019). Dec. 4, 2019.

Subramanian, R. Shankar et al., "Motion of a Drop on a Solid Surface Due to a Wettability Gradient", Lanqmuir, vol. 12, p. 11844-9, (2005). Nov. 4, 2005.

Yu, Xi et al., "Surface Gradient Material: From Superhydrophobicity to Superhydrophilicity", Langmuir, vol. 22, pp. 4483-6, (2006). Apr. 7, 2006.

Ito, Yoshihiro et al., "The Movement of a Water Droplet on a Gradient Surface Prepared by Photodegradation", Langmuir, vol. 23, pp. 1845-1850, (2007). Dec. 22, 2006.

Bhattacharjee, Biddut, "Study of Droplet Splitting in an Electrowetting Based Digital Microfluidic System", The University of British Columbia, Sep. 2012. Sep. 1, 2012.

Cho, Sung Kwon et al., "Creating, Transporting, Cutting, and Merging Liquid Droplets by Electrowetting-Based Actuation for Digital Microfluidic Circuits", Journal of Microelectromechanical Systems, vol. 12, No. 1, Feb. 2003. Feb. 1, 2003.

Nikapitiya, N. Y. Jagath B.et al., "Accurate, consistent, and fast droplet splitting and dispensing in electrowetting on dielectric digital microfluidics", Mirco and Nano Systems Letters, vol. 5, No. 24, Jun. 2017. Jun. 16, 2017.

Hadwen, B. et al., "Programmable large area digital microfluidic array with integrated droplet sensing for bioassays", Lab on a Chip, Issue 18, (2012). May 22, 2012.

Cooney, Christopher G. et al., "Electrowetting droplet microfluidics on a single planar surface", Microfluisics and Nanofluidics, vol. 2, Issue 5, pp. 435-446 (Sep. 2006). Sep. 1, 2006.

Fouillet, Y. et al., "EWOD Digital Microfluidics for Lab on a Chip", International Conference on Nanochannels, Microchannels, and Minichannels, Paper No. ICNMM2006-96020, pp. 1255-1264, (Sep. 2008). Sep. 15, 2008.

Nemani, Srinivasa Kartik et al., "Surface Modification of Polymers: Methods and Applications", Advanced Materials Interfaces, vol. 5, Issue 24, p. 1801247, Dec. 21, 2018. Dec. 21, 2018.

Hitzbleck, Martina et al., "Reagents in microfluidics: an 'in' and 'out' challenge", Chem. Soc. Rev., vol. 42, p. 8494, (2013). Mar. 27, 2013.

Walker, Shawn W. et al., "Modeling the Fluid Dynamics of Electro-Wetting On Dielectric (EWOD)", Journal of Microelectromechanical Systems, vol. 15, No. 4, pp. 986-1000, (Aug. 2006). Aug. 2006.

Li, Yiyan et al., "Improving the performance of electrowetting on dielectric microfluidics using piezoelectric top plate control", Sensors and Actuators B, vol. 229, pp. 63-74 (2016). 2016.

Barbulovic-Nad, Irena et al., "Digital microfluidics for cell-based assays", Lab Chip, vol. 8, pp. 519-526 (2008). Feb. 25, 2008.

(56) References Cited

OTHER PUBLICATIONS

Newman, Sharon et al., "High density DNA storage library via dehydration with digital microfluidic retrieval", Nature Communications, vol. 10, No. 1706 (2019). Apr. 12, 2019.
Dhindsa, Manjeet et al., "Virtual electrowetting channels: electronic liquid transport with continuous channel functionality", Lab on a Chip, Issue 7, pp. 832-836, (2010). Feb. 26, 2010.
International Preliminary Report on Patentability for Application No. PCT/US2021/013659, dated Jul. 28, 2022, 6 pages.
Korean Intellectual Property Office, "International Search Report and Written Opinion", PCT/US2021/013659, dated May 12, 2021.

* cited by examiner

SPATIALLY VARIABLE DIELECTRIC LAYERS FOR DIGITAL MICROFLUIDICS

RELATED APPLICATIONS

This application claims priority to U.S. Provisional Application No. 62/962,238, filed Jan. 17, 2020. All references, patents, and patent applications disclosed herein are incorporated by reference in their entireties.

BACKGROUND

Digital microfluidic (DMF) devices use independent electrodes to propel, split, and join droplets in a confined environment, thereby providing a "lab-on-a-chip." Digital microfluidic devices are alternatively referred to as electrowetting on dielectric, or "EWoD," to further differentiate the method from competing microfluidic systems that rely on electrophoretic flow and/or micropumps. FIG. 1 illustrates a typical EWoD device including both propulsion and sensing on the same active matrix. A 2012 review of the electrowetting technology was provided by Wheeler in "Digital Microfluidics," *Annu. Rev. Anal. Chem.* 2012, 5:413-40. The technique allows sample preparation, assays, and synthetic chemistry to be performed with tiny quantities of both samples and reagents. In recent years, controlled droplet manipulation in microfluidic cells using electrowetting has become commercially viable, and there are now products available from large life science companies, such as Oxford Nanopore.

Typically, EWoD devices include a stack of a conductor, an insulator dielectric layer, and a hydrophobic layer. A droplet is placed on the hydrophobic layer, and the stack, once actuated, can cause the droplet to deform and wet or de-wet from the surface depending on the applied voltage. Most of the literature reports on EWoD involve so-called "passive matrix" devices (a.k.a. "segmented" devices), whereby ten to twenty electrodes are directly driven with a controller. While segmented devices are easy to fabricate, the number of electrodes is limited by space and driving constraints. Accordingly, it is not possible to perform massive parallel assays, reactions, etc. in passive matrix devices. In comparison, "active matrix" devices (a.k.a. active matrix EWoD, a.k.a. AM-EWoD) devices can have many thousands, hundreds of thousands or even millions of addressable electrodes. The electrodes are typically switched by thin-film transistors (TFTs) and droplet motion is programmable so that AM-EWoD arrays can be used as general purpose devices that allow great freedom for controlling multiple droplets and executing simultaneous analytical processes.

The electrodes are typically switched by thin-film transistors (TFTs) and droplet motion is programmable so that AM-EWoD arrays can be used as general purpose devices that allow great freedom for controlling multiple droplets and executing simultaneous analytical processes. TFT arrays are highly desirable for this application, due to having thousands of addressable pixels, thus allowing mass parallelization of droplet procedures. In some instances, the pixel electrodes of the array may be differently sized, e.g., an area of high-density small pixel electrodes neighboring an area of low-density large pixel electrodes. Areas of differential pixel size facilitate rapid droplet dispensing from the reservoirs and subsequent droplet partitioning.

Traditionally, a single dielectric layer is used across the whole EWoD active surface, including regions that have different functions, or areas having different pixel densities.

Because the maximum operating voltage of an electrode is largely dictated by the properties of its dielectric, a single dielectric layer results in a relatively uniform maximum operating voltage all over the device. However, in most analytical applications, different areas of the EWoD array have different uses, thus requiring some areas to undergo much greater electrical strain, which can cause voltage leakage and eventual breakdown of the substrate. These failure modes are especially acute in the reservoir regions, which perform repeated high-voltage processes, such as droplet partitioning, and there is no flexibility to cycle a different spatial region for these processes because the reservoirs are not movable with respect to the array.

SUMMARY OF INVENTION

The present application addresses the problems typically associated with providing different voltages and/or waveforms to different regions of digital microfluidic devices by introducing a novel architecture with a spatially variable dielectric that is well suited to enabling different electrodes to operate at different potentials and frequencies. This architecture helps to preserve the functionality in high strain areas, such as adjacent the reservoirs. Accordingly, digital microfluidic devices of the invention have longer useful lifetimes than digital microfluidic devices without this architecture.

In one aspect, the present application provides a digital microfluidic device including a first plurality of electrodes of a first density that are coupled to a set of switches, a controller operatively coupled to the set of switches and configured to provide a propulsion voltage to at least a portion of the first plurality of electrodes, and a second plurality of electrodes of a second density and configured that operate at a higher voltage than the first plurality of electrodes. A first dielectric layer having a first dielectric constant and a first thickness covers the first plurality of electrodes, and a second dielectric layer having a second dielectric constant and a second thickness covers the second plurality of electrodes. In one embodiment, the density of the first electrodes is greater than the density of the second electrodes: accordingly, the first electrodes form a high-resolution zone, while the second electrodes form a low-resolution zone. In another embodiment, the dielectric constant of the first dielectric layer is greater than the dielectric constant of the second layer. In a further embodiment, the thickness of the first dielectric layer is smaller than the thickness of the second dielectric layer. The first and second dielectric layers may be contiguous or partially overlap. The device may also include a third plurality of reservoir electrodes that are configured to operate at a higher voltage than the first electrodes. In some instances, the device may include just the first and third reservoir electrodes and have no second electrodes. In one embodiment, the first electrodes are configured to operate at a potential between about 10 V and 20 V. In another, non-exclusive embodiment, the second electrodes are configured to operate at a potential between about 100 V and about 300 V. In an additional embodiment, the third electrodes are configured to operate at a potential between about 100 V and about 300 V. In example embodiments, the first dielectric layer has a thickness between about 50 nm and about 250 nm. In further, non-exclusive embodiments, the second dielectric layer has a thickness between about 500 nm to about 5 μm. The first electrodes may be configured to operate at a first frequency and the electrodes may be configured to operate at a second frequency. In one embodiment, the operating frequency of the first electrodes is smaller than the operating frequency of the second electrodes. Example types of switches include thin-film-transistors (TFT) and electro-mechanical switches.

DETAILED DESCRIPTION

As disclosed herein, the invention provides active matrix electrowetting on dielectric (AM-EWoD) devices that include a spatially variable dielectric structure. Accordingly, much greater voltages may be imposed in higher dielectric breakdown regions (e.g. reservoirs covered with thicker dielectric) than in the main array areas (e.g., TFT pixels). This architecture allows different driving schemes to be used within different regions of the EWoD device according to their dielectric properties. In some instances, the higher thickness robust dielectric may be removed and re-applied to the reservoir or adjacent regions. This design enables recycling these regions after they get fully fatigued, thereby extending the longevity of the device.

The use of spatially variable dielectrics across wide regions of an AM-EWoD device allows for different voltages and/or waveforms to be applied independently across the device in specialized areas. Also addressed is the issue of fatigue and breakdown by allowing higher stress regions to operate with thicker dielectrics at higher voltages while preventing catastrophic device failure. Moreover, a variable dielectric structure enables actuation strength increases in reservoir regions, which makes it easier to overcome capillary forces from fluid input systems. Because it is possible to increase the actuation strength with higher applied voltages, droplets from a reservoir have more predictable snap-off, which helps to regulate the volume of each droplet of reservoir fluid. Additionally, the higher actuation strength expands the range of materials that can be introduced from the reservoir onto the device.

In general, thicker dielectrics operating at higher voltages are more resistant to fatigue, while thinner dielectrics that are inherently more complex and fragile tend to fail more readily under electrical load. Furthermore, the minimum voltage required for actuation scales as the inverse square root of the capacitance, or proportionately to the square root of the thickness. Thus, operation at lower voltages (desirable for using high density TFT arrays) is challenging to achieve with variations in dielectric thickness alone. Likewise, using materials with increased dielectric constant requires complex deposition processes and inherent issues related to leakage due to mid-gap electronic states, structural deformities, and other factors.

Figure 1:
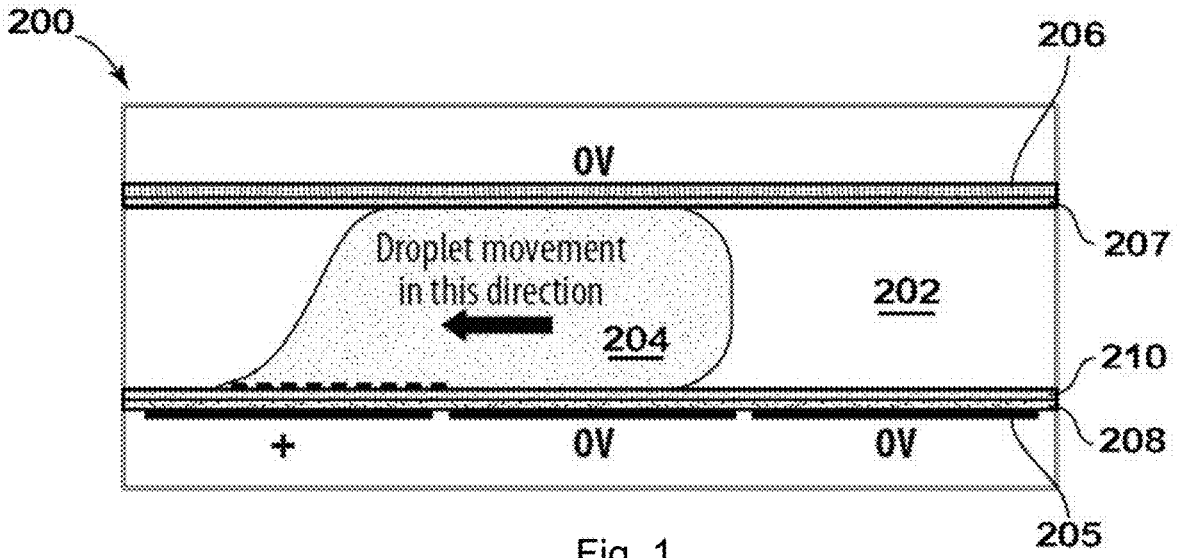
FIG. 1 illustrates the fundamental structure of an exemplary EWoD device.

The fundamental structure of an exemplary EWoD device is illustrated in the cross-sectional image of FIG. 1. The EWoD 200 includes a cell filled with an oil 202 and at least one aqueous droplet 204. The cell spacer is typically in the range 50 to 200 μm, but the spacer can be larger. In a basic configuration, as shown in FIG. 1, a plurality of propulsion electrodes 205 are disposed on the substrate and a singular top electrode 206 is disposed on the opposing surface. The cell additionally includes top hydrophobic layer 207 on the surfaces contacting the oil layer, as well as a dielectric layer 208 between the propulsion electrodes 205 and the bottom hydrophobic layer 210. (The upper substrate may also include a dielectric layer, but it is not shown in FIG. 1). The hydrophobic layer is typically 20 to 60 nm thick and prevents the droplet from wetting the surface. When no voltage differential is applied between adjacent electrodes, the droplet will maintain a spheroidal shape to minimize contact with the hydrophobic surfaces (oil and hydrophobic layer).

When a voltage differential is applied between adjacent electrodes, the voltage on one electrode attracts opposite charges in the droplet at the dielectric-to-droplet interface, and the droplet moves toward this electrode, also as illustrated in FIG. 1. As remarked above, the voltages needed for acceptable droplet propulsion largely depend on the properties of the dielectric. AC driving is used to reduce degradation of the droplets, dielectrics, and electrodes by various electrochemistries. Operational frequencies for EWoD can be in the range 100 Hz to 1 MHz, but lower frequencies of 1 kHz or lower are preferred for use with TFTs that have limited speed of operation.

Figure 2:
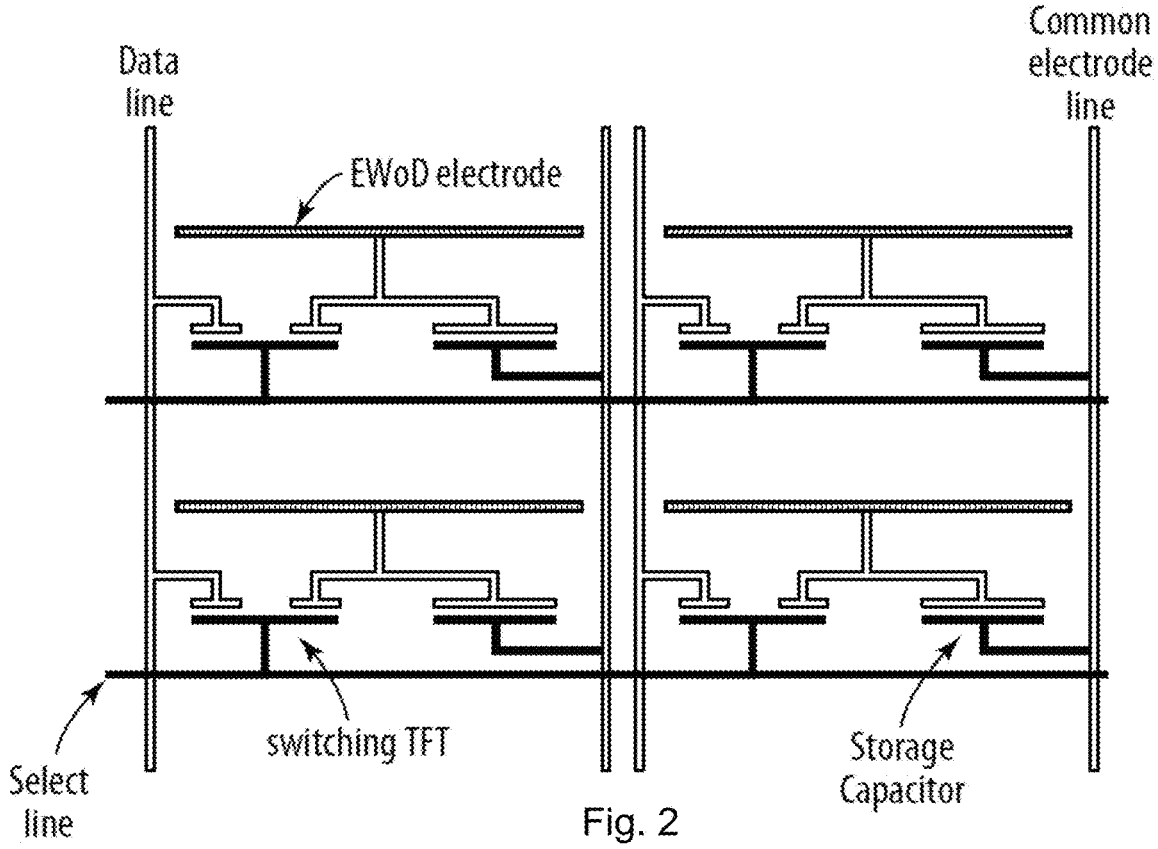
FIG. 2 is a schematic representation of a propulsion electrode controlled by a thin-film-transistor, such as commonly found in EWoD devices.

Returning to FIG. 1, the top electrode 206 is a single conducting layer normally set to zero volts or a common voltage value (VCOM) to take into account offset voltages on the propulsion electrodes 205 due to capacitive kickback from the TFTs that are used to switch the voltage on the electrodes (see FIG. 2). The top electrode can also have a square wave applied to increase the voltage across the liquid. Such an arrangement allows lower propulsion voltages to be used for the TFT connected propulsion electrodes 205 because the top plate voltage 206 is additional to the voltage supplied by the TFT.

As shown in FIG. 2, an active matrix of propulsion electrodes can be arranged to be driven with data and gate (select) lines much like an active matrix in a liquid crystal display. The gate (select) lines are scanned for line-at-a time addressing, while the data lines carry the voltage to be transferred to propulsion electrodes for electrowetting operation. If no movement is needed, or if a droplet is meant to move away from a propulsion electrode, then 0 V will be applied to that (non-target) propulsion electrode. If a droplet is meant to move toward a propulsion electrode, an AC voltage will be applied to that (target) propulsion electrode.

Figure 3A:
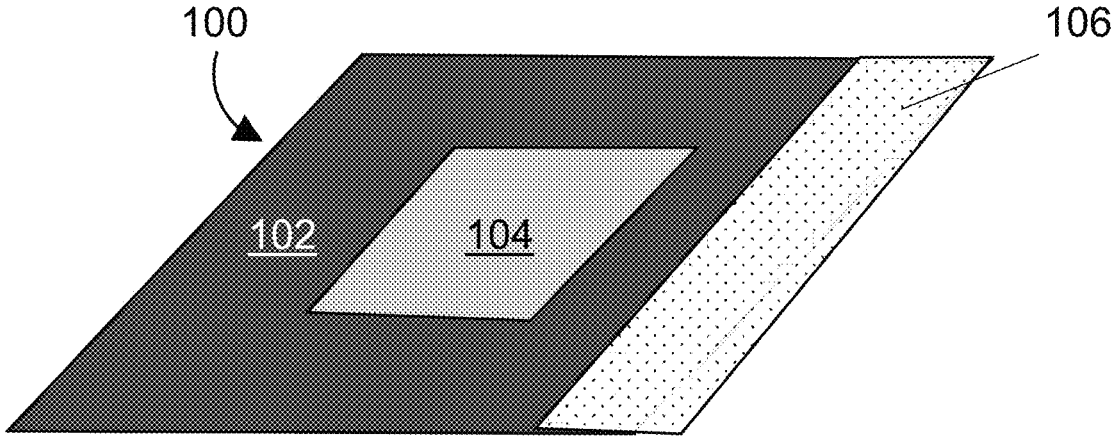
FIG. 3A illustrates the architecture of an exemplary spatially variable dielectric structure embodiment in the context of an electrowetting on dielectric (EWoD) array.
Figure 3B:
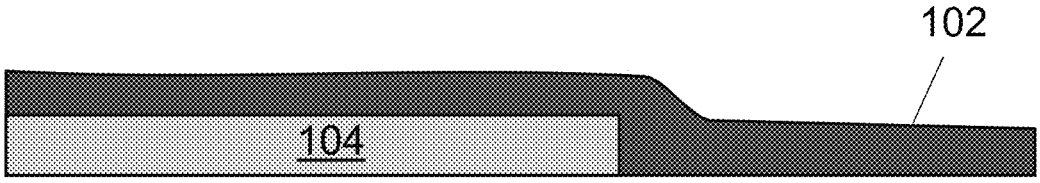
FIG. 3B is a cross-sectional illustration of two example dielectrics that overlap.
Figure 3C:
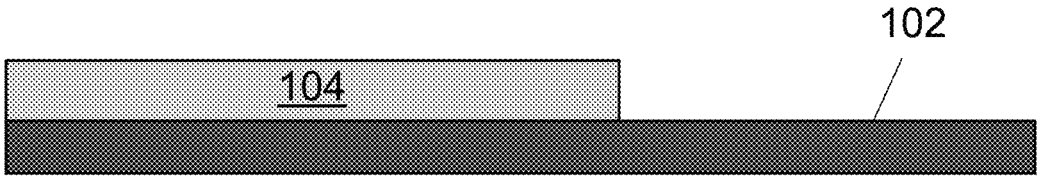
FIG. 3C is a cross-sectional illustration of another example of two dielectrics that overlap in part.

FIG. 3A illustrates the architecture of an exemplary spatially variable dielectric structure embodiment in the context of an EWoD array 100. A first dielectric 102 characterized by a dielectric constant $\varepsilon_1$ and thickness $t_1$ is laid over a high-density region of the array. A second dielectric 104 having dielectric constant $\varepsilon_2$ and thickness $t_2$ is deposited on a second, lower density region of the array that features separate driving electronics from the high-density region. As exemplified in the cross-sections of FIGS. 3B and 3C, the first and second dielectrics may mutually overlap at least in part and be formed according to a number of methods featuring different orders of deposition. Returning to FIG. 3A, third dielectric 106 may formed of either the first or second dielectric material. Alternatively, dielectric 106 may be made of a third material of dielectric constant $\varepsilon_3$ differing from both $\varepsilon_1$ and $\varepsilon_2$. The number of dielectrics may be further extended to four, five, or beyond, depending on the number of regions present on the EWoD, each region requiring its own specific combination of dielectric constant and thickness. In some embodiments, one or more dielectrics may be formed from two or more materials, either mixed together or layered on top of each other to form a material having a desired effective thickness.

Equation (1) establishes the relationship between actuated contact angle θ, resting contact angle $\theta_0$, per-area capacitance C, voltage V and liquid/environment surface tension γ:

$$\cos\theta = \cos\theta_0 + \frac{C}{2\gamma_{LG}}V^2 \tag{1}$$

EWoD performance is highly dependent on the difference between resting and actuated contact angles ($\theta-\theta_0$). The capacitance per unit area C is a function of dielectric constant E and dielectric thickness d according to Equation (2)

$$C = \frac{\varepsilon}{d} \tag{2}$$

It can be seen that, in order to increases the extent of actuation, it is desirable to have one or more of a high dielectric constant, a low thickness, and a high voltage.

One can envision tuning the parameter space such that the EWoD device operates at 75% of the breakdown voltage $V_B$, such that $V=0.75\cdot V_B$. Then, a relationship with the breakdown voltage can be seen in Equation (3), where F represents an actuation efficacy proportional to the difference in contact angles, and $V_B$ is expressed as the dielectric thickness d multiplied by the dielectric strength $D_S$, $V_B=D_S\cdot d$:

$$F \propto \frac{\varepsilon}{d}D_s^2 d^2 = \varepsilon D_s^2 d \tag{3}$$

It can be seen that the actuation efficacy increases at higher thicknesses and voltages, assuming operating voltages close to $V_B$ and that this benefit is not exactly offset by a decrease in permittivity for the thicker dielectric.

Equation (4) reflects that the minimum voltage $V_{min}$ is directly proportional to the square root of the dielectric thickness d in view of Equation (2), α being hysteresis of wetting and de-wetting:

$$V_{min} \approx 2\sqrt{\frac{\gamma\alpha\sin\theta_0}{C}} \tag{4}$$

This shows why operating at low voltages is quite difficult due to a need for aggressively reducing dielectric thickness or increasing dielectric permittivity. The dielectric thickness required to work at comparatively lower voltage ranges (e.g., about 10 V) results in a device much more prone to fatigue and failure. It has also been found that high thickness dielectrics operating at high voltage ranges tend to be more robust and provide large actuated contact angles compared to traditional, low-voltage platforms on thin film transistors (TFT).

Figure 4A:
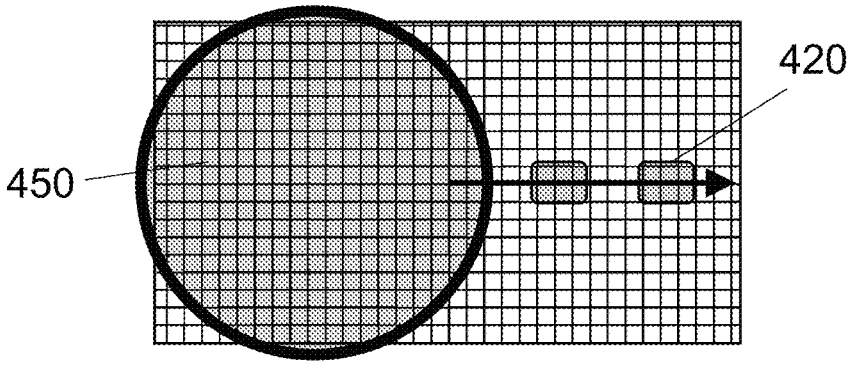
FIG. 4A is a schematic illustration of an EWoD reservoir using standard AM-TFT architecture.
Figure 4B:
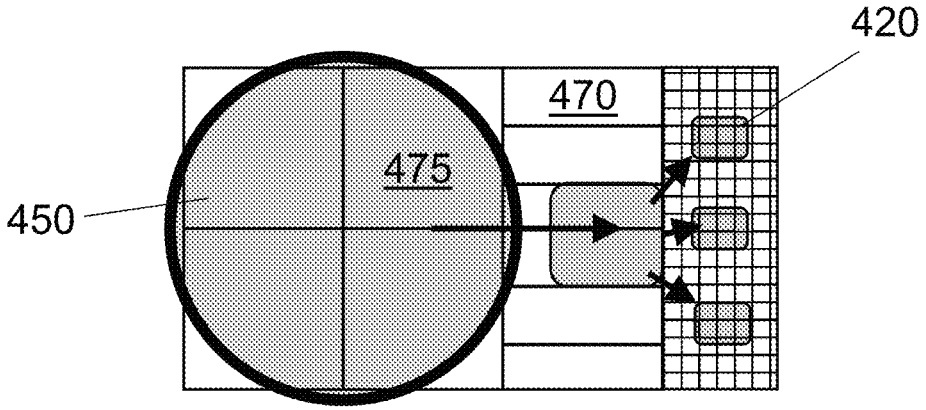
FIG. 4B is a schematic illustrations of an alternative reservoir architecture that uses specialized electrodes that may be directly driven at higher voltage.

Example higher-stress EWoD operations include reservoir regions featuring special electrode patterns as well as designated moderate-density electrode regions for low-resolution operations. An example of a reservoir region having specialty electrodes is exemplified in FIGS. 4A and 4B. As shown in FIGS. 4A and 4B, the gray color represents the droplet liquid and the grid lines represent the electrodes.

FIG. 4A is a schematic reservoir top view that is defined by a relatively high electrode density grid, and the resultant drops 420 may be of different size and of different aspect ratios. However, in FIG. 4A, if the electrodes are controlled by TFT switching, the overall voltage is limited to typically between 10 to 20 Volts in amplitude, for example −15V, 0V, and 15V. In order to reliably produce droplets 420 of the desired size from the reservoir area 450 the small electrodes must be driven at high frequency with maximum voltage differential, increasing the likelihood of failure in this region.

As an alternative, as shown in FIG. 4B, specialized electrodes 470, 475 may be implemented that can be driven with higher voltages. Additionally, because the reservoir 450 takes up a large area, it is possible to address this area with many fewer electrodes (e.g., lower density), thereby facilitating fabrication and reducing cost. As shown in FIG. 4B, directly-driven (i.e., segmented) electrodes of various sizes may be used to facilitate rapid and consistent partition into the desired sample droplets 420. Additionally, reservoir regions 450 typically require more frequent actuation, either constant or periodic, to form and dispense droplets to prevent fluids from escaping the reservoir region 450. This causes increased voltage strain in reservoir areas. The invention allows for greater electrowetting forces in more reservoir regions and enables operating reservoirs and adjacent regions independently, in terms of both voltage and frequency, from the rest of the EWoD array. By coupling specialized electrodes 470, 475 with low-voltage TFT electrodes, as shown in FIG. 4B, the same droplets 420 can be formed and then directly addressed, thereby allowing for variable frequency operation and advanced waveform patterns as in FIG. 4A, but with much greater reliability.

Figure 5:
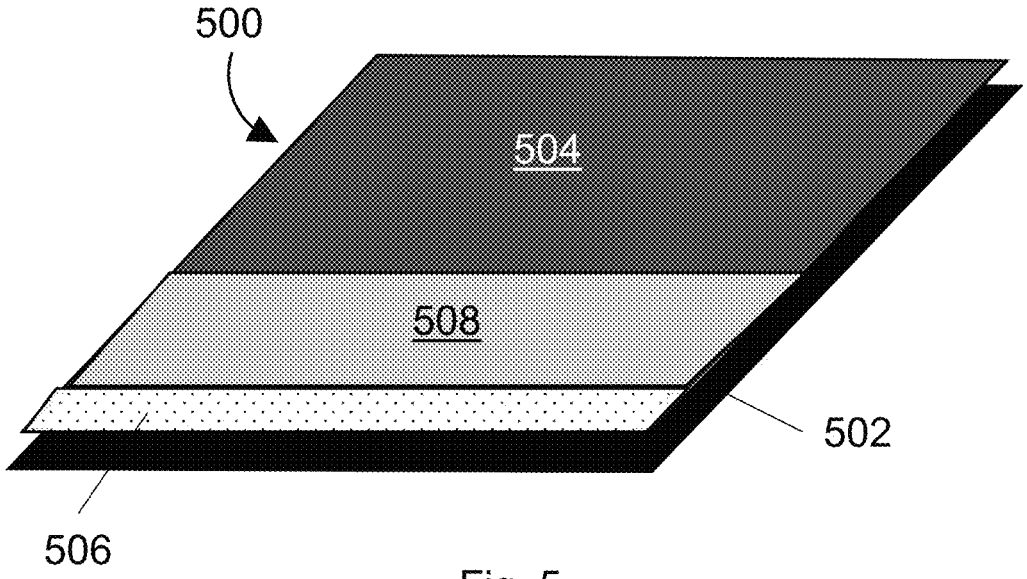
FIG. 5 illustrates the architecture of a spatially-variable dielectric structure in the context of an EWoD array having specialty reservoir electrodes.

FIG. 5 illustrates the architecture of a spatially variable dielectric structure in the context of an EWoD array 500 having areas with different electrode densities. This embodiment includes substrate 502, a low-voltage TFT array 504 operating in the range of about 10 V to 20 V, and high-voltage electrodes 506, 508 that are directly driven by an external source at variable frequencies and operating in the range of about 100 V to about 300 V. The high-voltage electrodes 506, 508 include customized reservoir electrodes 506 and an adjacent regular grid of low resolution movement electrodes 508. A thicker, more robust dielectric(s) covers the high-voltage areas 506 an 508. Thicker dielectrics are typically in the range of about 500 nanometers (nm) to about 5 micrometers (μm) and may include materials with low or moderate dielectric constant. Example materials suitable for the thick dielectric include polymers like parylene, fluorinated polymers such ethylene tetrafluoroethylene (ETFE), polytetrafluoroethylene (PTFE), or ceramic materials, e.g. titanium dioxide and aluminum oxide. Low-voltage regions are covered by a thin dielectric with high dielectric constant. Typically, thinner dielectrics are in the range of about 50 nm to 250 nm and include ceramic materials such as silicon dioxide, silicon nitride, hafnium oxide, alumina, tantalum oxide, and barium strontium titanate. In one example, the dielectric covering TFT array 504 is a hybrid ceramic stack having a high dielectric constant and from about 50 nm to 250 nm in thickness, while the dielectric covering low-resolution electrodes 508 are covered by is a parylene C layer of about 1 μm in thickness.

Dielectric layers may be manufactured with deposition methods commonly used in the art, for example sputtering, atomic layer deposition (ALD), spin coating, chemical vapor deposition (CVD), and other vacuum deposition techniques. Creating spatial profiles featuring two or more dielectrics of different materials and thickness may be achieved through, for instance, shadow masking, photolithography, and dry or wet etching techniques. If desired, the high dielectric thickness areas may be stripped for re-use since their robustness enables them to hold up much better to repeated actuation.

It will be apparent to those skilled in the art that numerous changes and modifications can be made in the specific embodiments of the invention described above without departing from the scope of the invention. Accordingly, the whole of the foregoing description is to be interpreted in an illustrative and not in a limitative sense.

The invention claimed is:

1. A digital microfluidic device, comprising:

a first plurality of electrodes having a first density and operatively coupled to a set of switches;

a controller operatively coupled to the set of switches and configured to provide a propulsion voltage to at least a portion of the first plurality of electrodes;

a second plurality of electrodes having a second density and configured to operate at a higher voltage than the propulsion voltage of the first plurality of electrodes;

a first dielectric layer having a first dielectric constant and a first thickness, the first dielectric layer covering the first plurality of electrodes, and a second dielectric layer having a second dielectric constant and a second thickness, the second dielectric layer covering the second plurality of electrodes.

2. The digital microfluidic device of claim 1, wherein the first density of the first plurality of electrodes is greater than the second density of the second plurality of electrodes.

3. The digital microfluidic device of claim 1, wherein the first dielectric constant of the first dielectric layer is greater than the second dielectric constant of the second dielectric layer.

4. The digital microfluidic device of claim 1, wherein the first thickness of the first dielectric layer is smaller than the second thickness of the second dielectric layer.

5. The digital microfluidic device of claim 1, wherein the first dielectric layer and the second dielectric layer are mutually overlapping in part.

6. The digital microfluidic device of claim 1, further comprising a third plurality of reservoir electrodes configured to operate at a higher voltage than the propulsion voltage of the first plurality of electrodes.

7. The digital microfluidic device of claim 1, wherein the first plurality of electrodes is configured to operate at a potential between about 10 V and about 20 V.

8. The digital microfluidic device of claim 1, wherein the second plurality of electrodes is configured to operate at a potential between about 100 V and about 300 V.

9. The digital microfluidic device of claim 1, wherein the first dielectric layer has a thickness between about 50 nm to about 250 nm.

10. The digital microfluidic device of claim 1, wherein the second dielectric layer has a thickness between about 500 nm to about 5 μm.

11. The digital microfluidic device of claim 1, wherein the first plurality of electrodes is configured to operate at a first frequency and the second plurality of electrodes is configured to operate at a second frequency.

12. The digital microfluidic device of claim 11, wherein the first frequency of operation of the first plurality of electrodes is smaller than the second frequency of operation of the second plurality of electrodes.

13. The digital microfluidic device of claim 1, wherein the switches are thin-film-transistors.

14. The digital microfluidic device of claim 1, wherein the switches are electro-mechanical switches.

15. The digital microfluidic device of claim 1, wherein the first dielectric layer comprises silicon dioxide, silicon nitride, hafnium oxide, alumina, tantalum oxide, or barium strontium titanate.

16. The digital microfluidic device of claim 1, wherein the second dielectric layer comprises parylene, ethylene tetrafluoroethylene (ETFE), polytetrafluoroethylene (PTFE), titanium dioxide, or aluminum oxide.

17. The digital microfluidic device of claim 1, wherein the second dielectric comprises a combination of layered materials selected from the group consisting of silicon dioxide, silicon nitride, hafnium oxide, alumina, tantalum oxide, barium strontium titanate, parylene, ethylene tetrafluoroethylene (ETFE), polytetrafluoroethylene (PTFE), titanium dioxide, and aluminum oxide.

* * * * *